United States Patent [19]

Finck et al.

[11] Patent Number: 4,747,891

[45] Date of Patent: May 31, 1988

[54] SOLID PROPELLANT CONTAINING AN AZIRIDINYL BONDING AGENT

[75] Inventors: Bernard Finck, Corbeil Essonnes; Gérard Doriath, Itteville; Jean-Pierre Martenot, Bergerac, all of France

[73] Assignee: Societe Nationale des Poudres et Explosifs, Paris, France

[21] Appl. No.: 907,624

[22] Filed: Sep. 15, 1986

[30] Foreign Application Priority Data

Sep. 19, 1985 [FR] France ..... 85 13871

[51] Int. Cl.[4] ..... C06B 45/10

[52] U.S. Cl. ..... 149/19.4; 149/19.9; 149/20; 548/956

[58] Field of Search ..... 149/19.4, 19.9, 20; 548/956

[56] References Cited

U.S. PATENT DOCUMENTS

| | | | |
|---|---|---|---|
| 3,428,484 | 2/1969 | Kenaga | 117/155 |
| 3,790,416 | 2/1974 | Dehm | 149/19.4 |
| 3,932,353 | 1/1976 | Mastrolra et al. | 149/19.4 |
| 4,019,933 | 4/1977 | Cucksee et al. | 149/19.4 |
| 4,090,893 | 5/1978 | Cucksee et al. | 149/19.9 |
| 4,158,583 | 6/1979 | Frosch | 149/19.4 |
| 4,263,070 | 4/1981 | Price et al. | 149/19.4 |
| 4,427,468 | 1/1984 | Duchesne et al. | 149/19.4 |
| 4,429,634 | 2/1984 | Byrd et al. | 149/19.9 |

OTHER PUBLICATIONS

Ladd et al, *Chem Abs*, 89 (#7), Abs #54682e (1978).

Stokes et al, *Chem. Abs.*, 95 (#28), Abs #186960c (1981).

Bollinger et al, *Chem Abs.*, 103 (#9), Abs. #71410q (1985).

*Primary Examiner*—Edward A. Miller

*Attorney, Agent, or Firm*—Bucknam and Archer

[57] ABSTRACT

The binder/charge adhesive of the present invention makes it possible to improve the bonding between the charges and the polyurethane binder of a propellent composition. This agent is an aminoaziridinylphosphine oxide of general formula:

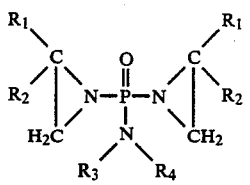

in which $R_1$, $R_2$, $R_3$ and $R_4$ are identical or different and denote a hydrogen atom or a methyl or ethyl radical. The present invention finds application particularly in the field of the manufacture of solid propellent compositions.

7 Claims, No Drawings

SOLID PROPELLANT CONTAINING AN AZIRIDINYL BONDING AGENT

The present invention relates to a binder/filler adhesive and a propellent composition with improved mechanical properties and feasibility, containing this adhesive.

It relates more particularly to a binder/filler adhesive for a polyurethane binder, and a compound propellant containing polyurethane binder.

Compound propellent compositions for rockets, missiles or gas generators consist of a binder which is generally nonenergetic and is a reducing agent for the oxidizing agent fillers and, if desired, reducing agent fillers. The oxidizing agent charges are generally inorganic salt oxidizing agents such as ammonium perchlorate, for example, while the reducing agent charges are usually metallic, and generally aluminium, charges.

These propellent compositions are preferably used for the manufacture of large blocks produced by casting the composition in a mould and then polymerizing the binder.

When the mould consists of the propellant casing, there is no need to demould the block manufactured in this manner, which adheres directly to the casing, and this is then described as a cast and glued block. In other cases, where the block is cast in a separate mould and is then demoulded and arranged in the propellant casing, the block is called a free block.

In all these configuraions the propellant must have mechanical properties of a high order, especially to enable it to be handled, or to withstand the stresses produced by distortions, such as the expansion of the propellant casing. These stresses are particularly high in the case of cast and glued blocks because the block is glued to the propellant casing.

BRIEF DESCRIPTION OF THE DRAWINGS

The mechanical properties of a propellant are characterized by parameters which are determined by subjecting a specimen of the propellant to a simple tensile test and by recording the tensile curve shown in the single FIGURE.

The following parameters are determined from this curve, as shown in the single FIGURE:

$S_m$: maximum tensile strength (Pa)

$\epsilon$: elastic elongation (%)

$e_b$: elongation at break (%)

$e_m$: minimum elongation at maximum traction (%)

E: Young's modulus (Pa).

To make it possible to compare propellants in respect of their mechanical properties, the product $S_m.e_m$ is generally considered, by analogy with the product $S_m.\epsilon$ used in the case of elastic materials, representing the maximum energy which the material can take up without undergoing irreversible damage.

The mechanical properties of a propellant are determined largely by the nature of the binder, the degree of polymerization and the crosslinking of the binder. Thus, short polyols, such as trimethylolpropane are usually added to composite propellants containing a polyurethane binder, to increase the degree of crosslinking between the polymer chains.

Other components of the propellant affect its mechanical properties. Thus, the nature of the plasticizer is of importance.

However, the phenomenon which determines propellant cohesion is the interaction between the binder and the charge. In fact, the loss of adhesion between the binder and the charges gives rise to voids around the latter, which reduce propellant cohesion and thus weaken its mechanical properties. These losses of adhesion may be produced especially when the propellant is elongated under the action of the expansion of the propellant casing. This phenomenon is irreversible.

To improve the binder/filler formed, compounds are added which have, on the one hand, some degree of affinity for the filler and, on the other hand, chemical groups permitting linking to the macromolecular chains of the binder.

The compounds which are most widely employed are compounds containing aziridinyl rings and especially trimethylaziridinylphosphine oxide known under the acronym MAPO.

MAPO derivatives have also been proposed, especially the compounds produced by the reaction of MAPO with a carboxylic acid.

The purpose of the present invention is to offer a new compound having improved properties of reinforcing the mechanical properties of the composition and especially of the bond between the charge and the binder and thus making it possible to manufacture propellent compositions having improved mechanical properties and feasibility.

To this end, the invention provides a binder/filler adhesive and a polyurethane binder characterized in that the said binder/filler adhesive is an aminoaziridinylphosphine oxide of general formula (I):

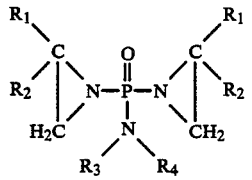

(I)

in which: $R_1$, $R_2$, $R_3$ and $R_4$, which may be identical or different, denote the hydrogen atom or a methyl or ethyl radical.

According to a preferred characteristic of the invention, $R_1$ and $R_3$ denote the hydrogen atom and $R_2$ and $R_4$ denote the methyl radical.

The invention also relates to a compound propellent composition with a polyurethane resin-based binder, containing as chief components oxidizing agent fillers and, if desired, reducing agent fillers, and at least one binder/filler adhesive, characterized in that the said adhesive is an aminoaziridinylphosphine oxide such as defined above.

According to another characteristic of the invention, the weight concentration of aminoaziridinylphosphine oxide compound in the propellent composition is between 0.5 and 3% and preferably between 0.5 and 1.5% of the weight of the binder.

The propellent composition may contain polymerization catalysts, combustion catalysts, plasticizers, antioxidants and any ballistic additive usually employed in compound propellants, in usual proportions, and well-known to the specialist.

The polyurethane resins are produced by condensing a polyol, usually a diol, with a polyisocyanate.

The most frequently used polyols which may be mentioned are polyesters containing hydroxyl end groups obtained from diethylene glycol or ethylene glycol and adipic acid or azelaic acid, polyethers containing hydroxyl end groups prepared from polyoxytetramethylene glycol,polyoxypropylene glycol or similar, and polybutadienes containing hydroxyl end groups denoted by the acronym PBHT, and known as hydroxytelechelic polybutadienes.

In a preferred embodiment of the invention, the polyurethane binder is obtained from a hydroxytelechelic polybutadiene with a mean molecular weight of 1,000 to 5,000, having a hydroxyl functionality of between 2 and 3, advantageously in the region of 2.3.

As preferred hydroxytelechelic polybutadienes of the invention there may be mentioned those marketed by the American company ARCO Chemical Company under the tradenames R45M and R45HT.

As polyisocyanate compounds which are suitable as a crosslinking agent there may be mentioned, by way of example: toluene diisocyanate (TDI), hexamethylene diisocyanate (HMDI), dimeryl diisocyanate (DDI), isophorone diisocyanate (IPDI), -,3,5-tri(6-isocyanato)-biuret (marketed by the Bayer A. G. company under the name Desmodur N100), 4,4'-methylenebiscyclohexyl diisocyanate (MDCI), or similar.

Suitable oxidizing agent fillers are, for example: ammonium perchlorate, potassium nitrate, or similar. The preferred charge of the invention is ammonium perchlorate.

It is possible, furthermore, to add nitramines to these oxidizing agent fillers, such as cyclotrimethylenetrinitramine or hexogen (RDX), cyclotetramethylenetetranitramine or octogen (HMX), or pentaerythritol tetranitrate (PETN), or similar.

Suitable reducing agent fillers for the invention are generally metal powders such as powdered aluminium, beryllium, zirconium or similar.

The preferred reducing agent filler of the invention is aluminium powder.

The aminoaziridinylphosphine oxide compounds of the invention may be prepared especially by means of the following two processes.

The first process consists in manufacturing the compound of formula (II):

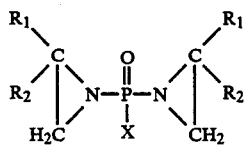

(II)

in which X denotes a halogen and $R_1$ and $R_2$ have the above meaning, according to the processes described in U.S. Pat. Nos. 2,606,900 and 3,201,313, and then reacting this compound with an amine of formula (III) to obtain the compound of formula (I):

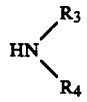

(III)

in which $R_3$ and $R_4$ have the above meaning.

The second process consists in carrying out the following reaction:

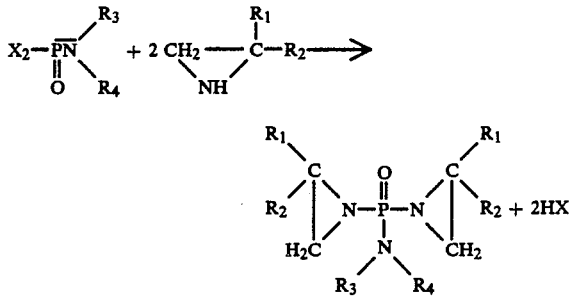

Toluene is used as a solvent, together with a halogen-acid scavenger (X denotes a halogen atom, preferably chlorine), such as triethylamine or 2-methylaziridine.

The reaction is carried out at low temperature, of the order of 0° C. to −5° C.

After separation of the hydrohalide formed, for example by filtering and evaporating the solvent, the aminoaziridinylphosphine oxide is recovered.

This compound is then purified, for example by distillation under reduced pressure.

In the case of the synthesis of bismethylaziridinylmethylaminophosphine oxide which, for the sake of simplicity will be referred to hereinafter as methyl-BAPO, a slightly yellow liquid is recovered, which crystallizes to a white product with a density of 1.0855 kg/dm$^3$ and a boiling point of 115° C. at 13.3 Pa.

The dihaloaminophosphine may be obtained by reacting a phosphorus oxyhalide with an alkylamine hydrohalide.

The alkyl aziridine may be obtained, in particular by the Wenker and Gabriel syntheses described in the *Journal of the American Chemical Society,* vol. 57 page 2328 (1935) and in Beilstein vol. 21 page 1049 (1881), respectively.

The following examples, which are given solely by way of indication and are not limiting in any way, clearly illustrate the invention and demonstrate its details, purposes and advantages.

EXAMPLE 1

The compound propellent composition is obtained by the usual process of manufacture which consists, briefly, in adding to the mixture of the polyols, in this example the hydroxytelechelic polybutadiene, additives such as wetting plasticizers, antioxidants and crosslinking agents, after which the reducing agent filler is added. The mixture obtained is then poured into a mixer in which the oxidizing agent filler and the crosslinking agent will be added, together with the various ballistic additives such as combustion catalysts and crosslinking catalysts.

The propellant thus obtained is then cast to form a block of the required size and shape.

A propellant with the following weight composition was prepared according to this method:

binder:

hydroxytelechelic polybutadiene (PBHT): 63.4% (marketed by ARCO Chemical under the name R45M)

plasticizer: 22.6% polyisocyanate (DDI): 12.0% (marketed by General Mills Chemicals under the name Brand diisocyanate 1410)

antioxidant: 2.0% the composition contains:

binder: 10% oxidizing agent ($NH_4ClO_4$): 70% reducing agent (Al): 20%

A composition was produced without any binder/filler adhesion promoter, as well as three other compositions in which the binder contained, respectively, 1% by weight based on the mass of the binder, of trimethylolpropane, of a condensate of MAPO with tartaric acid, and of methyl-BAPO. This last composition corresponds to the invention. (Table I.a)

TABLE I.a

| Composition | Binder/filler adhesive | Concentration, % of the binder |
|---|---|---|
| 1 | none | |
| 2 | trimethylolpropane (TMP) | 1% |
| 3 | MAPO/tartaric acid condensate | 1% |
| 4 | methyl-BAPO | 1% |

The feasibility of these compositions was tested and their mechanical properties, collated in the Table I.b below, were measured:

TABLE I.b

| Composition | Viscosity at 70° C. KPa s 1 h after casting | 2 h after casting | Mechanical properties after 14 days' cure at 40° C. $S_m$ (Mpa) | $\epsilon$ % | $e_m$ % | $e_b$ % | $S_m e_m$ | 14 days' cure at 50° C. $S_m$ (MPa) | $\epsilon$ % | $e_m$ % | $e_b$ % | $e_m S_m$ |
|---|---|---|---|---|---|---|---|---|---|---|---|---|
| 1 | 2.14 | 3.17 | 0.52 | 12 | 16 | 19 | 8.32 | 0.53 | 12 | 15 | 18 | 7.9 |
| 2 | 1.70 | 3.5 | 0.9 | 7 | 10 | 12 | 9. | 1.0 | 4 | 6 | 6 | 6 |
| 3 | 1.00 | 1.35 | 0.87 | 11 | 14 | 16 | 12.18 | 0.88 | 11 | 15 | 17 | 13.2 |
| 4 | 0.72 | 0.9 | 0.82 | 17 | 27 | 30 | 22.14 | 0.85 | 18 | 28 | 32 | 23.8 |

These results show, firstly, that the composition according to the invention, namely that containing methyl-BAPO as a reinforcing agent for the mechanical properties or for binder/filler adhesion, has the lowest viscosity and, secondly, that the binder/filler adhesive according to the invention is the only one which makes it possible to obtain a composition having a high tensile strength ($S_m$) and a greatly increased degree of elongation ($e_m$).

This result is clearly shown by the comparison of the products $e_m S_m$.

EXAMPLE 2

Compositions are produced using the method of Example 1, with the same binder, but the propellant has the following composition:

binder: 14% oxidizing agent ($NH_4ClO_4$): 70% reducing agent (Al): 16%

As in Example 1, three compositions are prepared, the first of which contains no binder/filler adhesive, and the other two contain, respectively, tri(methylaziridinyl)-phosphine oxide (MAPO) and bis(aziridinyl)methylaminophosphine oxide (BAPO) as binder/filler adhesive, in a concentration of 2% by weight based on the mass of binder. (Table II.a).

TABLE II.a

| Composition | Binder/filler adhesive | Concentration, % of the binder |
|---|---|---|
| 5 | none | |
| 6 | MAPO | 2% |
| 7 | BAPO | 2% |

The viscosity and the mechanical properties of the compositions obtained are collated in Table II.b.

TABLE II.b.

| Composition | Viscosity at 70° C. KPa s 1 h after casting | 2 h after casting | Mechanical properties after 14 days' cure at 40° C. $S_m$ (Mpa) | $\epsilon$ % | $e_m$ % | $e_b$ % | $S_m e_m$ | 14 days' cure at 50° C. $S_m$ (MPa) | $\epsilon$ % | $e_m$ % | $e_b$ % | $S_m e_m$ |
|---|---|---|---|---|---|---|---|---|---|---|---|---|
| 5 | 0.22 | 0.29 | 0.22 | 31 | 49 | 59 | 10.78 | 0.24 | 35 | 51 | 60 | 12.24 |
| 6 | 0.23 | 0.26 | 1.46 | 11 | 16 | 17 | 23.36 | 1.98 | 11 | 15 | 16 | 29.70 |
| 7 | 0.28 | 0.32 | 1.03 | 25 | 39 | 40 | 41.20 | 1.22 | 29 | 38 | 40 | 46.36 |

These results show that the binder/filler adhesive according to the present invention makes it possible to obtain propellants which have very advantageous mechanical properties, particularly a high tensile strength ($S_m$) for a high elongation value ($e_m$). On the other hand, the known binder/filler adhesive, namely MAPO, makes it possible to increase appreciably the propellant's tensile strength ($S_m$), but tends to reduce the elongation value of the composition.

Bearing in mind the low viscosity of the composition, the addition of a binder/charge adhesive affects it in only a small degree.

EXAMPLE 3

A propellent composition is prepared using the process of Example 1 with a binder of the following composition by weight:

polyoxypropylene glycol: 63.9% trimethylolpropane: 1.2% plasticizer: 21.7% toluene diisocyanate: 8.0% copper chromite: 4.7% zinc dithiobenzimidazolate: 0.5%

In a manner identical to Examples 1 and 2, the compositions were manufactured, containing, respectively: no binder/filler adhesive, 1.5% by weight of bisaziridinylmethylaminophosphine oxide and 0.5% by weight of bisaziridinyldimethylaminophosphine oxide. (Table III.a) (The concentrations are expressed in % by weight of the binder.)

TABLE III.a

| Composition | Binder/filler adhesive | Concentration, % of the binder |
|---|---|---|
| 8 | none | |
| 9 | bisaziridinylmethyl-aminophosphine oxide | 1.5 |
| 10 | bisaziridinyldi-methylaminophosphine oxide | 0.5 |

The viscosity and the mechanical properties of these compositions are collated in Table III.b.

TABLE III.b.

| | Viscosity at 60° kPa s | | Mechanical properties at 20° C. after 14 days' cure at 40° C. | | | | |
|---|---|---|---|---|---|---|---|
| Composition | 1 h after casting | 2 h after casting | $S_m$ MPa | $\epsilon$ % | $e_m$ % | $e_b$ % | $S_m e_m$ |
| 8 | 4.5 | 5.5 | 1.54 | 22 | 36 | 44 | 55.44 |
| 9 | 6 | 7.6 | 1.68 | 29 | 56 | 61 | 94.08 |
| 10 | 6.85 | 8.6 | 1.60 | 23 | 49 | 55 | 78.40 |

These results also show that that two aminoaziridinylphosphine oxides according to the invention have a beneficial effect on the mechanical properties of the propellants obtained.

EXAMPLE 4

Several propellants are produced using the binder described in Example 1, but containing other oxidizing agent fillers.

The propellant composition is as follows:

binder: 12% oxidizing agent: $NH_4ClO_4$: 50% combustion modifier: oxamide: 5% nitramine: octogen: 15% reducing agent: aluminium: 18%

As in the preceding examples, several compositions are produced, in which the binder/filler adhesive which is present in a concentration of 0.5% by weight of the binder is, respectively, methyl-BAPO, (Composition 11)

NN,N'N'-di-1,2-propyleneisophthalamide (Composition 12):

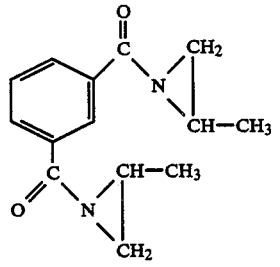

NN,N'N',N''N''-tri-1,2-propylenetrimesamide (Composition 13):

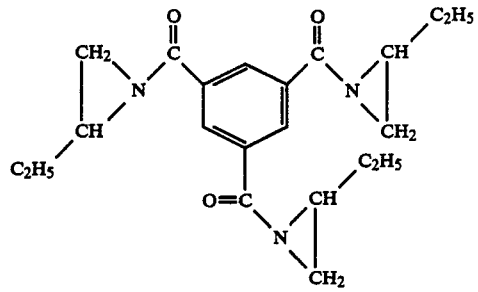

The agents in compositions 12 and 13 are known aziridinyl compounds employed in compound propellants.

As in the preceding examples, the viscosity and the mechanical properties of the compositions obtained are collated in Table IV.

TABLE IV

| | Viscosity at 60° C. KPa s | | Mechanical Properties after 14 days' cure at 40° C. | | | | | |
|---|---|---|---|---|---|---|---|---|
| Composition | 1h after casting | 2h after casting | $S_m$ MPa | $\epsilon$ % | E MPa | $e_m$ % | $e_b$ % | $S_m e_m$ |
| 11 | 0.34 | 0.51 | 1.0 | 18 | 6 | 30 | 34 | 30 |
| 12 | 0.50 | 0.75 | 1.1 | 11 | 10 | 18 | 22 | 19.8 |
| 13 | 0.42 | 0.56 | 1 | 12 | 9 | 21 | 25 | 20.9 |

These results show that the binder/filler adhesive of the invention makes it possible to obtain a higher elongation value than do other agents, for a substantially identical tensile strength.

The agent of the invention also has a beneficial effect on the feasibility of the compositions, by lowering their viscosity.

EXAMPLE 5

The optimum concentration of binder/filler adhesive must be determined for each composition. The following results show, however, that this concentration may be between 0.5 and 3.0% by weight of the binder and that the best results are obtained for concentrations of between 0.5 and 1.5%.

These tests were carried out using the same binder as in Example 1, except that the hydroxytelechelic polybutadiene is that marketed by the ARCO Chemical Company under the name R45HT.

The propellant has the following composition by weight:

binder: 14%

$NH_4ClO_4$: 82% aluminium: 4%

| | Mechanical properties after 4 days' cure at 60° C. | | | | | | | | | | | |
|---|---|---|---|---|---|---|---|---|---|---|---|---|
| | at 20° C. | | | | | | at −45° C. | | | | | |
| (1) | $S_m$ MPa | $\epsilon$ % | E MPa | $e_m$ % | $e_b$ % | $S_m e_m$ | $S_m$ MPa | $\epsilon$ % | E MPa | $e_m$ % | $e_b$ % | $S_m e_m$ |
| 0.2 | 0.35 | 8.3 | — | 11 | 14 | 3.85 | 1.3 | 4.6 | 28 | 10 | 17 | 13 |
| 0.5 | 0.38 | 8.4 | — | 12 | 17 | 4.56 | 1.2 | 3.8 | 30 | 6 | 18 | 7.2 |
| 1.0 | 0.60 | 13 | 5 | 30 | 33 | 18 | 2.1 | 3.9 | 53 | 7 | 21 | 14.7 |
| 1.5 | 0.72 | 15 | 5 | 34 | 37 | 24.48 | 2.2 | 6.7 | 33 | 38 | 44 | 83.6 |
| 2.0 | 0.87 | 13 | 6 | 30 | 32 | 26.10 | 2.3 | 7.0 | 33 | 37 | 42 | 85.10 |
| 3.0 | 0.90 | 14 | 6 | 29 | 36 | 26.10 | 2.4 | 7.6 | 32 | 38 | 43 | 91.20 |

(1) concentration of methyl-BAPO as % by weight of the binder.

Furthermore, swelling tests using binders charged with aluminium or otherwise have shown that the binder/aluminium adhesion is greater in the presence of an adhesive according to the invention.

These same tests carried out using propellent compositions such as described in Example 1 show a marked increase in adhesion in the presence of an adhesive according to the invention, and especially in the presence of methyl-BAPO.

The binder/filler adhesive of the invention, namely an aminoaziridinylphosphine oxide, makes it possible to obtain compound propellants with improved mechanical properties, in particular having, for a high tensile strengths, a value of the degree of elongation which is also high.

In addition, this agent makes it possible to increase the feasibility of the propellant blocks by reducing the viscosity of the compositions for an equal charge concentration.

Furthermore, bearing in mind the low concentrations which are used, this binder/filler adhesive has no effect on the ballistic properties of the propellant and, in particular, does not affect its burning speed or specific impulse.

We claim:

1. A propellant composition which contains in addition to a polyurethane binder, energetic material, an oxidizing agent and a reducing agent and at least an adhesive of formula I:

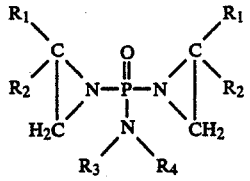

wherein $R_1$, $R_2$, $R_3$ and $R_4$ are the same or different and are hydrogen, methyl or ethyl.

2. The composition according to claim 1 wherein the weight concentration of said compound of formula I is between 0.5% and 3% of the weight of the binder.

3. The composition according to claim 2 wherein the concentration of said compound of formula I is between 0.5% and 1.5% of the weight of the binder.

4. The composition according to claim 1 wherein said polyurethane binder is a product of condensation of a hydroxytelechelic polybutadiene with an aromatic, aliphatic or alicyclic diisocyanate.

5. The composition according to claim 1 wherein said oxidizing agent is a member selected from the group consisting of ammonium perchlorate, potassium perchlorate, sodium perchlorate, ammonium nitrate and potassium nitrate, and said reducing agent is a member selected from the group consisting of aluminum, zirconium and beryllium.

6. The composition according to claim 1 wherein said energetic material is a member selected from the group consisting of octogen, hexogen and pentaerythritol tetranitrate.

7. The composition according to claim 1 wherein the oxidizing agent is ammonium perchlorate and the reducing agent is aluminum.

* * * * *